US006561176B1

(12) United States Patent
Fujimoto et al.

(10) Patent No.: US 6,561,176 B1
(45) Date of Patent: May 13, 2003

(54) PAINT BALL GUN

(76) Inventors: Douglas W. Fujimoto, 2204 S. 284th St., Federal Way, WA (US) 98003; Steven Caldon, 3211 Regent Pl., Caldwell, ID (US) 83605

( * ) Notice: Subject to any disclaimer, the term of this patent is extended or adjusted under 35 U.S.C. 154(b) by 0 days.

(21) Appl. No.: 10/037,846

(22) Filed: Oct. 19, 2001

(51) Int. Cl.[7] ..... F41B 11/00
(52) U.S. Cl. ..... 124/76; 124/73; 124/31
(58) Field of Search ..... 124/76, 70, 71, 124/31, 73, 74, 75; 42/69.01, 69.02

(56) References Cited

U.S. PATENT DOCUMENTS 5,280,778 A * 1/1994 Kotsiopoulos ..... 124/73
5,913,303 A * 6/1999 Kotsiopoulos ..... 124/31
6,233,928 B1 * 5/2001 Scott ..... 60/407
6,276,354 B1 * 8/2001 Dillon ..... 124/74
6,360,736 B1 * 3/2002 Juan ..... 124/77
6,382,200 B1 * 5/2002 Levkov ..... 124/73

* cited by examiner

*Primary Examiner*—Peter M. Poon
*Assistant Examiner*—Floris Chad Copier
(74) *Attorney, Agent, or Firm*—David L. Tingey

(57) ABSTRACT

A paint ball gun with typical gun body bolt chamber, air chamber, hammer chamber and trigger plate aligns the trigger plate with a timing plate and air valve to eliminate torques otherwise incurred between the valve and a trigger integral with the trigger plate as the trigger pulls the valve between effective positions during firing and recocking of the gun. The timing plate reciprocates with movement of the trigger plate in a timing plate groove in the gun body, shielding the timing plate from external damage and dirt. The air chamber and the hammer chamber, typically rearward of the air chamber, together lie below the bolt chamber and above the timing plate groove in vertical alignment further stabilizing the gun during recocking and firing of the gun.

10 Claims, 2 Drawing Sheets

PAINT BALL GUN

BACKGROUND OF THE INVENTION

This invention relates generally to automatic or semiautomatic, pneumatically-fired guns, and more particularly to paint ball guns.

Paint ball guns generally comprise a body with a hand grip, a barrel mounted on the body through which a paint ball is propelled, a magazine of projectiles feeding into the barrel, a trigger on a trigger plate, a sear retaining the striker in a cocked position by the trigger plate, and a source of compressed gas with a valve regulating compressed gas into the barrel. A spring-powered hammer and valve pin moves forward under spring bias during firing to impact and move a valve cup seal forward. As the valve cup seal moves forward, a body chamber filed with compressed gas opens to a bolt chamber and barrel attached thereto. A bolt moves linearly in the bolt chamber from a cocked position in which the magazine is unblocked forward to a firing position that pneumatically seals the barrel/bolt chamber from the magazine as compressed gas is received into the barrel/bolt chamber to expel a projectile from the gun.

For an automatic or semiautomatic gun the valve is three-way to also direct compressed gas to move the striker to a cocked position ready for next firing. As the trigger is further pulled past release of the sear, the timing rod acts through a mechanical assembly to direct gas through with the three-way valve to a ram that pushes the hammer and bolt rearward to the cocked position, reengaging the sear at the trigger in preparation for a next firing. Typically, the mechanical assembly comprises a threaded timing rod connected between the timing rod and a coupler at the three-way valve adjustable on its threads at the coupler to achieve correct timing.

The effective length of the timing rod is precise to assure that gas is released at only the appropriate time to recock the gun. If the timing rod is set improperly, the gun cocks at the wrong time relative to the firing sequence, or not at all, and the gun fails to operate.

The timing rod is generally a rod external to the gun body with a hooked end entering the body near the trigger to engage a hole in the trigger plate. Threads on its other end engage the three-way valve at the valve coupler external to the body by threading the rod into a coupler threaded hole. Thus, the timing rod alongside the gun body and trigger plate extends to the coupler threaded hole offset from a line between the trigger plate and the coupler threaded hole. A small torque is therefore generated through the timing rod between the trigger plate and the coupler that can affect the aim of the gun. Further, after repeated use, the timing rod tends to move on its threads in the coupler, changing its effective length and consequently the gun timing. As a result, the gun requires servicing to reset the rod in the coupler threads to an appropriate effective length. And in the meantime, the gun remains out of proper timing, though it may continue to function in less than optimum adjustment.

SUMMARY

It is an object of the invention to provide a mechanism that circumvents the heretofore inherent mistiming, or at least eventual mistiming, of this type of gun. It is a further object to eliminate any torques between the trigger and the three-way valve that might alter gun timing or misaim the gun during firing. It is also an object to stabilize the gun with a vertical alignment of primary moving parts.

Because the trigger plate is within the gun body, and the valve coupler and three-way valve are mounted forward on the body, traditionally a timing plate is mounted external to the gun body off-axis from the trigger plate and the three-way valve, hooked on each end to connected to the trigger plate and coupler, respectively. This off-axis hooked rod causes a torque to be generated between the trigger plate and hooked rod and also between the hooked rod and the coupler, both of which cause the gun to misaim upon pulling the trigger. These torques are eliminated by connecting the trigger plate to the valve coupler with a timing plate within a groove in the gun body in straight alignment, resulting in the timing plate, trigger plate and coupler moving together in alignment on a single straight line. Thus, the gun body has a new timing plate groove opening at the trigger plate on one end and the coupler on the other end, thus eliminating the external timing plate that created the unwanted torques. The timing plate is connected to the trigger plate with a lug in a notch to avoid a solid connection that could transmit trigger plate torques to the timing plate. Because the timing plate moves entirely within the body failures due damage to the external timing plate and due also to dirt getting in the timing plate that preventing it from reliably sliding are eliminated.

Primary components of the gun comprise an upper bore in the gun body that includes the barrel and the bolt chamber. A projectile mounts on top of the gun body and feeds projectiles, frangible paint balls, into the bolt chamber. Below the upper bore is a second bore that includes a hammer chamber rearward of an air chamber. The hammer chamber encloses a hammer that strikes a valve cup seal between the hammer chamber and the air chamber, allowing pressurized gas to release from the air chamber through a passage to the bolt chamber and into a bolt passage through the bolt exhausting forward of the bolt to propel the paint ball in front of the bolt. Below the second bore is a third bore running from the gun front to the trigger plate low in the gun body. (Although the gun is characteristically constructed with a handle frame screwed onto a body block, for ease of description herein, the gun body is deemed to include both the body block and the handle frame.) In the third bore is a reciprocating timing plate aligned between the trigger plate and a three way valve that directs compressed air to automatically recock the gun. To provide improved balance and minimize internal torques during firing that can cause misaiming of the gun, the three bores—the bolt chamber, the hammer and air chamber chambers, and the timing plate groove—are arranged in vertical alignment in a plane defined by the movement of the trigger plate.

DETAILED DESCRIPTION OF THE PREFERRED EMBODIMENT

Figure 1:
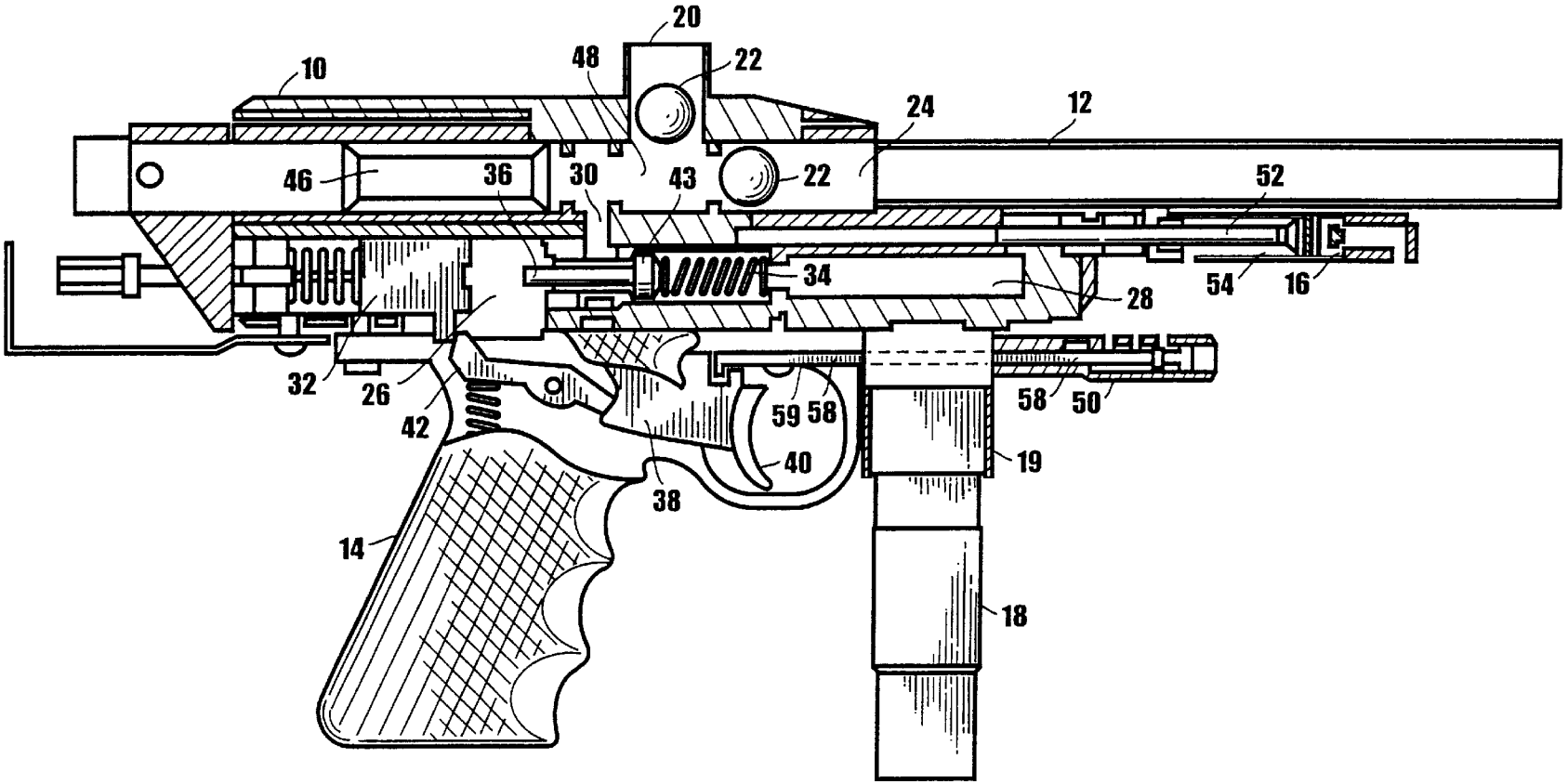
FIG. 1 is a cutaway view of the gun of the present invention.
Figure 4:
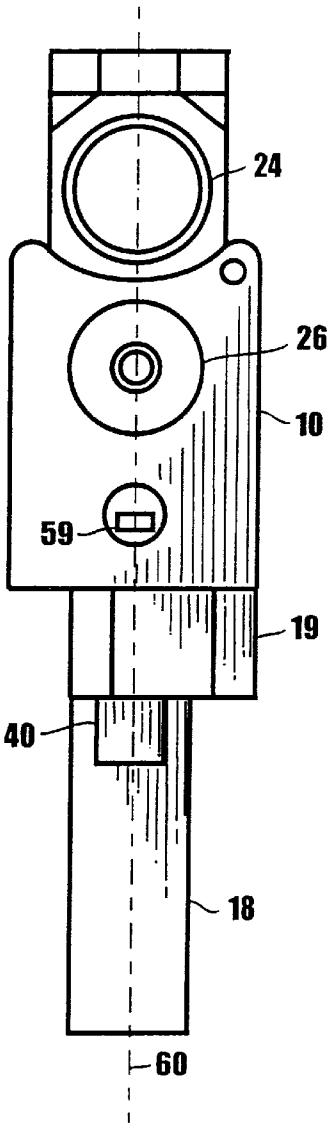
FIG. 4 is an front end view of the gun showing alignment in a single plane of the bolt chamber (and/or barrel), air chamber, which lies forward of the hammer chamber, and valve in front of the timing plate, and trigger plate.
Figure 3:
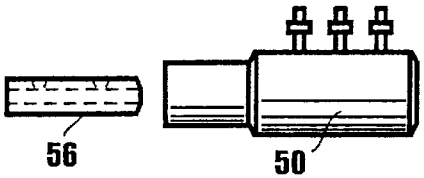
FIG. 3 is an end view of the trigger plate, timing plate, valve coupler and valve showing alignment in a single plane.
Figure 3:
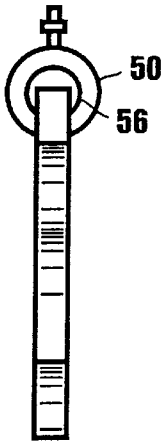
Figure 2:
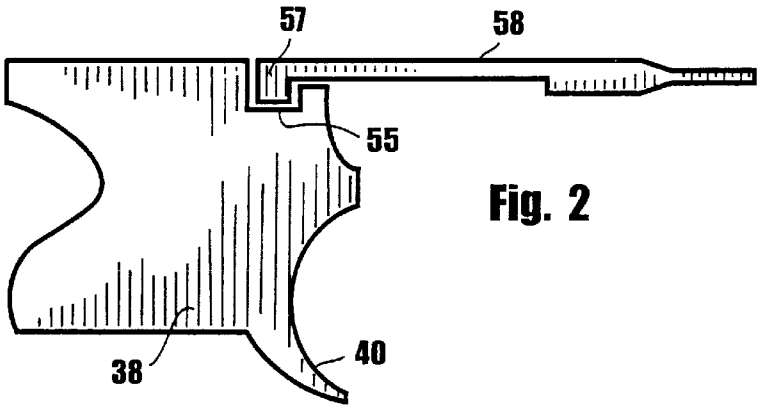
FIG. 2 is aside view of the trigger plate, timing plate, valve coupler and valve showing alignment.

The gas-powered gun of the present invention comprises a gun body 10 with attached barrel 12, handle 14, ram assembly 16, air regulator 18 received into a receptacle 19 on the gun body with a compressed gas bottle connectable to the air regulator, the valve connectable to the compressed gas bottle through the gas bottle regulator, the receptacle directing compressed air from the bottle to the air chamber and also to the valve in regulated fluid communication with the ram assembly for recocking the hammer, and a projectile magazine 20 mounted to the gun body 10 that provides projectiles 22 into a bolt chamber 24 in the upper portion of the gun body 10. The bolt chamber 24 opens forward of the gun body 10 through which the projectile (a frangible paint ball) in the bolt chamber 24 may be expelled through the barrel 12. Also in the gun body below the bolt chamber are a hammer chamber 26 rearward of an air chamber 28 with an air passage 30 between the air chamber 28 and the bolt chamber 24.

A hammer 32 reciprocates in the hammer chamber 26 between a cocked position (shown in FIG. 1) and a firing position. A spring 34 urges the hammer 32 from the cocked position to the firing position during the firing operation where it strikes an exhaust valve pin 36. A trigger plate 38, including a trigger 40, engages a sear 42 that releasably restrains the hammer32 in the cocked position against spring bias so the hammer 32 is released when the trigger 40 is pulled.

The exhaust valve pin 36 includes a cup seal 42 on its end closes the hammer chamber 26 from the air chamber 28 until the hammer 32 strikes the exhaust valve pin36. When struck by the hammer 32, the exhaust valve pin 36 moves to a forward position that opens the air chamber 28, allowing air from the air chamber to flow passed the cup seal 42 and valve pin 36 to the bolt chamber 24.

A bolt 46 reciprocates in the bolt chamber 24 in concert with the hammer 32 reciprocating in the hammer chamber 26 between the cocked position and the firing position. With the bolt rearward in the bolt chamber, the bolt 46 seals the air passage 30 and opens the projectile magazine 20 to accept a projectile 22 into the bolt chamber forward of the bolt 46. With the bolt forward in the bolt chamber in the firing position, the bolt seals the projectile magazine from the bolt chamber. The bolt 46 has an air channel 48 that aligns on its circumference with the air passage 30 when the bolt is in its firing position and exhausts forward from the bolt axially into the bolt chamber expelling a projectile in the bolt chamber forward of the bolt and out of the gun body as compressed gas passes from the air chamber past the cup seal and through the air passage, through the bolt air channel to the projectile.

A three-way valve 50 is attached on the gun body 10, which receives the compressed gas bottle and air regulator 18. Air is directed generally from the air regulator 18 to the air chamber 28. Air is also directed from the air regulator 18 to the three-way valve 50. In a valve first position, air is directed to a ram assembly 16 mounted on the gun body to recock the hammer and bolt. The ram assembly 16 includes a ram 52 moving rearward under compressed air pressure. When the ram chamber 54 is charged with air pressure, the ram moves rearward pushing the mechanically-linked bolt 46 and hammer 32 rearward to their cocked position, the hammer 32 moving past the sear 42, which sear holds the hammer 32 in the cocked position until released. With the bolt in its cocked position, a paint ball enters from the projectile magazine into the gun body in front of the bolt, ready for a next firing.

A valve coupler 56 on the three-way valve 50 controls movement of the valve between its positions. A timing plate 58 reciprocating in a timing plate groove 59 opening at the trigger plate on one end and the coupler on the other end connects between the trigger plate 38 and the valve coupler 56 such that pulling the trigger 40 moves the trigger plate38, timing plate 58 and valve coupler 56 rearward first, releasing the sear 42 to fire the gun. Then upon further movement of the trigger rearward, the trigger 40 pulls the valve coupler 56 to its second position for recocking the hammer. The trigger 40 then returns upon release under spring bias to its unpulled position and drives the three-way valve 50 to its first position.

To connect the timing plate to the trigger plate without transmitting a torque inherent in pulling the trigger, the timing plate includes a lug 57 depending from one end into a vertical notch 55 in the trigger plate 58. The timing plate is also characteristically noncircular, even rectangular, so it cannot twist in its bore, or groove, which matches the timing plate. Thus, the timing plate cannot twist or rise to transmit a torque to the coupler that could cause the timing plate to unscrew from the coupler and lose crucial timing.

The trigger movement from its unpulled position to its pulled position defines a vertical plane 60. The trigger plate 38 lies in this plane with the timing plate 58. Thus, the straight line that the trigger plate 38, timing plate 58 and valve coupler 56 moves in is within the plane 60 defined by the movement of the trigger.

Having described the invention, what is claimed is as follows:

1. A gas-powered gun comprising:

a gun body with a bolt chamber opening forward of the gun body through which a projectile in the bolt chamber may be expelled, a hammer chamber and an air chamber with an air passage between the air chamber and the bolt chamber, a hammer reciprocating in the hammer chamber between a cocked position and a firing position, a spring urging the hammer from the cocked position to the firing position, a trigger plate including a trigger, a sear engaging the trigger and releasably restraining the hammer in the cocked position against spring bias such that the hammer is released when the trigger is pulled, an exhaust valve pin with cup seal in the hammer chamber closing the air chamber to the bolt chamber until the exhaust valve pin is struck by the hammer moving the exhaust valve pin to an open position establishing fluid communication between the air chamber and the bolt chamber, a projectile magazine mounted to the gun body adapted to feed a projectile into the bolt chamber, a bolt between the air passage reciprocating in the bolt chamber in concert with the hammer in the hammer chamber between said cocked position rearward in the bolt chamber, wherein the bolt seals the air passage and opens the projectile magazine to accept said projectile into the bolt chamber forward of the bolt, to a firing position forward in the bolt chamber, wherein the bolt seals the projectile magazine from the bolt chamber, the bolt having an air channel aligning with the air passage with the bolt in said firing position and exhausting forward from the bolt into the bolt chamber expelling a projectile in the bolt chamber forward of the bolt from the gun body under pressure of compressed gas from the compressed gas bottle and stored in the air chamber, past the cup seal and through the air passage and through the bolt air channel, a three way valve having a first position and a second recocking position, a ram assembly including a ram moving rearward under compressed air pressure received through the three valve, the ram pushing the bolt, and the hammer mechanically linked thereto, rearward to said cocked position past the sear, which sear holds the hammer and thus also the bolt in cocked position until released by the trigger, a receptacle on the gun body to which a gas bottle regulator and compressed gas bottle may be attached, the valve connectable to the compressed gas bottle through the gas bottle regulator, the receptacle directing compressed air from the bottle to the air chamber and also to the valve in regulated fluid communication with the ram assembly for recocking the hammer, a coupler controlling effective three way valve position in directing compressed air during recocking and firing, a timing plate aligned in connection between the trigger plate and the coupler such that pulling the trigger moves the trigger plate, timing plate and coupler in a line rearward first releasing the sear to fire the gun and then moving the three way valve to its recocking position, directing compressed air to the ram assembly to recock the hammer, the trigger then returning upon release to its unpulled position under spring bias, the timing plate, trigger plate and coupler moving together in alignment.

2. The gun of claim 1 wherein the trigger and trigger plate moves in a plane with the timing plate and coupler aligned in that plane.

3. The gun of claim 1 wherein the coupler moves in a line in controlling movement of the valve between said valve positions, and the timing plate lies in said line extended, the timing plate, trigger plate and coupler moving together on said line without a torque between the timing plate and trigger plate or timing plate and coupler.

4. The gun of claim 1 wherein the timing plate moves internally within the gun body, shielded from external dirt and damage from inadvertent bumping.

5. The gun of claim 4 wherein the gun body has a timing plate groove passing through it between the trigger plate and the coupler with the timing plate passing through the timing plate groove, with the timing plate, trigger plate and valve coupler moving together in alignment on said line in said timing plate groove, the gun body timing plate groove opening at the trigger plate on one end and the coupling on the other end.

6. The gun of claim 1 wherein the timing plate includes a lug depending from one end into a vertical notch in the trigger plate therein linking the timing plate to the trigger plate in said plane without a torque between them.

7. The gun of claim 5 wherein the valve coupler has a threaded hole and the timing plate has a threaded end engaging the valve coupler threaded hole, the length of the timing plate and valve coupler in combination adjustable by an amount of rod threaded into the threaded hole to adjust timing of the gun by setting a preferred a distance of the valve from the trigger plate defining a position of the trigger plate and trigger when air from the valve directs compressed air to the ram for recocking the interconnected hammer and bolt.

8. The gun of claim 1 wherein the bolt chamber, the hammer chamber and the trigger plate are aligned in a vertical plane.

9. The gas-powered gun of claim 1 wherein the timing plate is noncircular preventing rotation in the timing plate groove, also matching noncircular, in which it reciprocates.

10. A gas-powered gun comprising:

a gun body with a bolt chamber opening forward of the gun body through which a projectile in the bolt chamber may be expelled, a hammer chamber and an air chamber with an air passage between the air chamber and the bolt chamber, a hammer reciprocating in the hammer chamber between a cocked position and a firing position, a spring urging the hammer from the cocked position to the firing position, a trigger plate including a trigger, a sear engaging the trigger and releasably restraining the hammer in the cocked position against spring bias such that the hammer is released when the trigger is pulled, an exhaust valve pin with cup seal in the hammer chamber closing the air chamber to the bolt chamber until the exhaust valve pin is struck by the hammer moving the exhaust valve pin to an open position establishing fluid communication between the air chamber and the bolt chamber, a projectile magazine mounted to the gun body adapted to feed a projectile into the bolt chamber, a bolt between the air passage reciprocating in the bolt chamber in concert with the hammer in the hammer chamber between said cocked position rearward in the bolt chamber, wherein the bolt seals the air passage and opens the projectile magazine to accept said projectile into the bolt chamber forward of the bolt, to a firing position forward in the bolt chamber, wherein the bolt seals the projectile magazine from the bolt chamber, the bolt having an air channel aligning with the air passage with the bolt in said firing position and exhausting forward from the bolt into the bolt chamber expelling a projectile in the bolt chamber forward of the bolt from the gun body under pressure of compressed gas from the compressed gas bottle and stored in the air chamber, past the cup seal and through the air passage and through the bolt air channel, a three way valve having a first position and a second recocking position, a ram assembly including a ram moving rearward under compressed air pressure received through the three way valve, the ram pushing the bolt, and the hammer mechanically linked thereto, rearward to said cocked position past the sear, which sear holds the hammer and thus also the bolt in cocked position until released by the trigger, a receptacle on the gun body to which a gas bottle regulator and compressed gas bottle may be attached, the valve connectable to the compressed gas bottle through the gas bottle regulator, the receptacle directing compressed air from the bottle to the air chamber and also to the three way valve in regulated fluid communication with the ram assembly for recocking the hammer, a coupler controlling effective three way valve positions in directing compressed air during recocking and firing, a timing plate aligned in connection between the trigger plate and the coupler such that pulling the trigger moves the trigger plate, timing plate and coupler in a line rearward first releasing the sear to fire the gun and then moving the three way valve to its recocking position, directing compressed air to the ram assembly to recock the hammer, the trigger then returning upon release to its unpulled position under spring bias, the timing plate, trigger plate and coupler moving together in alignment, wherein the gun body further has a timing plate groove passing through it between the trigger plate and the coupler with the timing plate passing through the timing plate groove, with the timing plate, trigger plate and valve coupler moving together in alignment on said line in said timing plate groove, the gun body timing plate groove opening at the trigger plate on one end and the coupling on the other end, and wherein the timing plate moves in parallel with the hammer and the bolt, and the bolt, hammer and timing plate align in a vertical plane in the gun body.

* * * * *